US008899170B2

(12) United States Patent
Bell

(10) Patent No.: US 8,899,170 B2
(45) Date of Patent: Dec. 2, 2014

(54) OBJECT LOCATING APPARATUSES

(76) Inventor: Brandon Bell, West Monroe, LA (US)

( * ) Notice: Subject to any disclaimer, the term of this patent is extended or adjusted under 35 U.S.C. 154(b) by 413 days.

(21) Appl. No.: 13/353,440

(22) Filed: Jan. 19, 2012

(65) Prior Publication Data

US 2013/0047912 A1 Feb. 28, 2013

Related U.S. Application Data

(60) Provisional application No. 61/461,677, filed on Jan. 21, 2011.

(51) Int. Cl.
*B63C 7/26* (2006.01)
*B63B 22/10* (2006.01)

(52) U.S. Cl.
CPC ..... *B63C 7/26* (2013.01)
USPC ..... 116/209; 116/107; 441/7; 441/8

(58) Field of Classification Search
CPC ..... B63B 22/08; B63B 22/10; B63C 7/26
USPC ..... 116/107, 200, 209, 210, DIG. 7; 441/6, 441/7, 8, 9, 95
See application file for complete search history.

(56) References Cited

U.S. PATENT DOCUMENTS

| | | | | | |
|---|---|---|---|---|---|
| 2,190,531 | A * | 2/1940 | Kaboskey et al. | 441/8 |
| 2,528,799 | A * | 11/1950 | Strong | 441/8 |
| 2,539,548 | A * | 1/1951 | Norris et al. | 441/8 |
| 2,588,637 | A * | 3/1952 | Krantz | 441/8 |
| 2,675,568 | A * | 4/1954 | King | 441/8 |
| 2,723,404 | A * | 11/1955 | Krantz | 441/8 |
| 2,791,785 | A * | 5/1957 | Metts | 441/8 |
| 3,049,733 | A * | 8/1962 | Mennenga | 441/8 |
| 3,303,521 | A * | 2/1967 | Mix | 441/9 |
| 3,366,983 | A * | 2/1968 | Adams | 441/8 |
| 3,982,294 | A * | 9/1976 | Hicken | 441/8 |
| 4,126,907 | A * | 11/1978 | Fish | 441/8 |
| 4,713,031 | A * | 12/1987 | Fuller | 441/8 |
| 4,796,167 | A * | 1/1989 | Brown et al. | 362/158 |
| 5,156,562 | A * | 10/1992 | Pearson et al. | 441/8 |
| 8,167,670 | B1 * | 5/2012 | Gibson et al. | 441/2 |
| 2007/0234632 | A1 * | 10/2007 | Strickland | 43/25 |
| 2012/0174854 | A1 * | 7/2012 | Weatherford | 116/209 |

* cited by examiner

*Primary Examiner* — R. A. Smith
(74) *Attorney, Agent, or Firm* — R. Keith Harrison

(57) ABSTRACT

An illustrative embodiment of an object locating apparatus includes a cartridge having a cartridge interior; a float in the cartridge interior; a float attachment line attached to the float and the cartridge; a water-dissolvable float retainer tablet retained in the cartridge interior; a cartridge cap in the cartridge interior; and a spring normally sandwiched and compressed between the cartridge cap and the float retainer tablet and adapted to expand and push the float from the container interior upon dissolving of the float from the retainer tablet.

17 Claims, 10 Drawing Sheets

OBJECT LOCATING APPARATUSES

CROSS-REFERENCE TO RELATED APPLICATIONS

This application claims the benefit of U.S. provisional application No. 61/461,677, filed Jan. 21, 2011 and entitled "OBJECT LOCATING APPARATUS", which provisional application is incorporated by reference herein in its entirety.

FIELD

Embodiments of the disclosure generally relate to apparatuses for locating objects which fall into a body of water. More particularly, embodiments of the disclosure relate to an object locating apparatus which releases a visible float to the surface of a water body to mark the location of an object to which the apparatus is attached in the event that the object falls into the water body.

BACKGROUND

A variety of situations have existed in which an object inadvertently falls into a body of water and location and retrieval of the object is desired. For example, a shotgun or rifle may inadvertently fall into a water body during hunting; target shooting or the like or a fishing rod may inadvertently fall into a water body during fishing. Attempts may be made to locate an object submerged in a water body by extending a net or other elongated object into the water, attempting to locate the object by feel and then dredging or scooping and lifting the object from the bottom of the water body to the water surface. However, this method is difficult to implement successfully since the water in which the object is submerged may be murky and thus may significantly hamper visual location of the object. Moreover, as it descends in the water, the object may travel and reach the bottom of the water body in a different location than the location at which the object disappeared from the surface. This may render difficulty in locating the object for retrieval.

Accordingly, embodiments of an object locating apparatus which releases a visible float to the surface of a water body to mark the location of an object to which the apparatus is attached in the event that the object falls into the water body are disclosed.

SUMMARY

The disclosure is generally directed to an object locating apparatus. An illustrative embodiment of the apparatus includes a cartridge having a cartridge interior; a float in the cartridge interior; a float attachment line attached to the float and the cartridge; a water-dissolvable float retainer tablet retained in the cartridge interior; a cartridge cap in the cartridge interior; and a spring normally sandwiched and compressed between the cartridge cap and the float retainer tablet and adapted to expand and push the float from the cartridge interior upon dissolving of the float retainer tablet.

In some embodiments, the object locating apparatus may include a cartridge having a cartridge interior; a float in the cartridge interior; a float attachment line attached to the float and the cartridge; a water-dissolvable pressure tablet in the cartridge interior, the pressure tablet adapted to generate pressurized gas upon contact with water; and a cartridge cap in the cartridge interior generally adjacent to the pressure tablet.

In some embodiments, the object locating apparatus may include a cartridge having a cartridge interior; a float in the cartridge interior; a float attachment line attached to the float and the cartridge; a trigger plate in the cartridge interior; a solenoid having an actuator flange positional into and out of the cartridge interior generally between the float and the trigger plate, the actuator flange normally positioned in the cartridge interior; water-sensing circuitry connected to the solenoid; and a spring normally biasing the trigger plate against the actuator flange and adapted to expand and push the float from the cartridge interior upon positioning of the actuator flange of the solenoid out of the cartridge interior.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
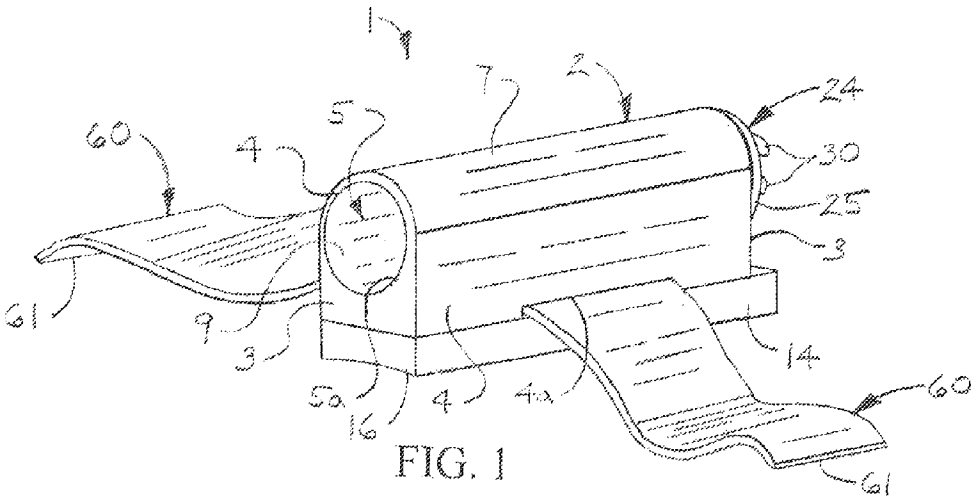
FIG. 1 is a front perspective view of an illustrative embodiment of the object locating apparatus.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Referring initially to FIGS. 1-8 of the drawings, an illustrative embodiment of the object locating apparatus, hereinafter apparatus, is generally indicated by reference numeral 1. The apparatus 1 may include a cartridge 2 which may have a generally elongated shape. The cartridge 2 may include a pair of spaced-apart cartridge end walls 3. A pair of generally elongated, parallel, spaced-apart cartridge side walls 4 may extend between the cartridge end walls 3. A cartridge top wall 7 may connect the cartridge side walls 3. In some embodiments, the cartridge top wall 7 may be generally curved, as illustrated. The cartridge 2 may be metal, plastic or other material which is consistent with the functional requirements of the apparatus 1.

Figure 4:
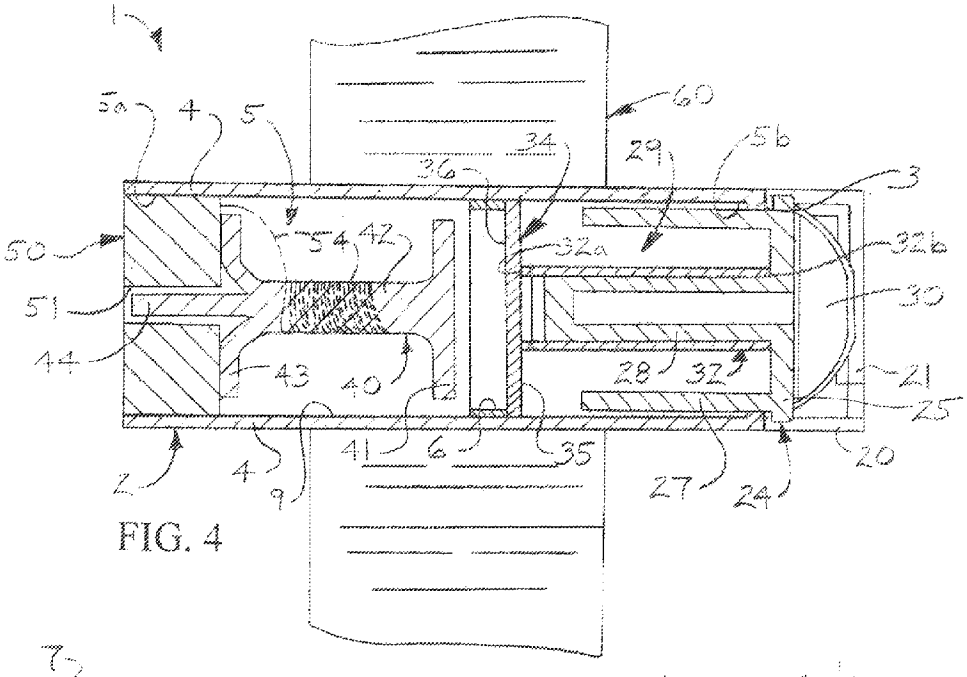
FIG. 4 is a longitudinal sectional view of an illustrative embodiment of the object locating apparatus, with a float of the apparatus deployed in a pre-release configuration.
Figure 6:
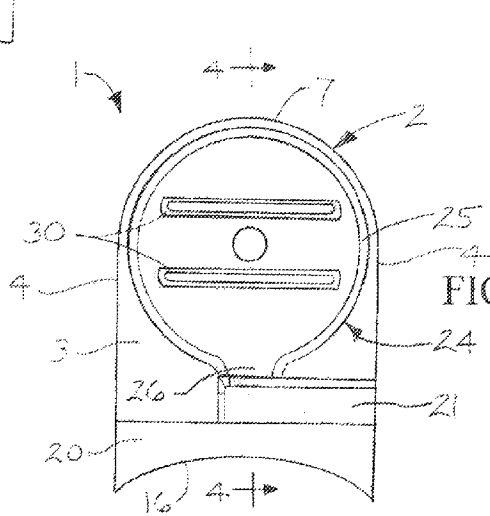
FIG. 6 is a rear view of an illustrative embodiment of the object locating apparatus, with the cartridge cap deployed in a locking position.
Figure 5:
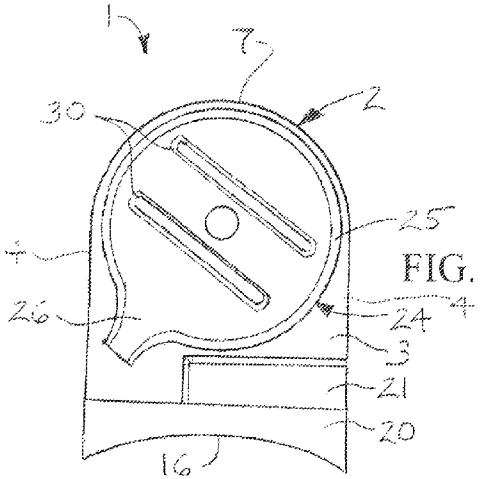
FIG. 5 is a rear view of an illustrative embodiment of the object locating apparatus, with a cartridge cap deployed in an unlocking position.

The cartridge 2 of the apparatus 1 has a cartridge interior 5. The cartridge interior 5 may have a generally elongated, cylindrical cartridge interior surface 9. As illustrated in FIG. 4, the cartridge interior 5 may have a float exit end 5*a* and a cap end 5*b*. A tablet retainer flange 6 may extend from the cartridge interior surface 9 into the cartridge interior 5 for purposes which will be hereinafter described. The tablet retainer flange 6 may be disposed between the float exit end 5*a* and the cap end 5*b* of the cartridge interior 5.

Figure 3:
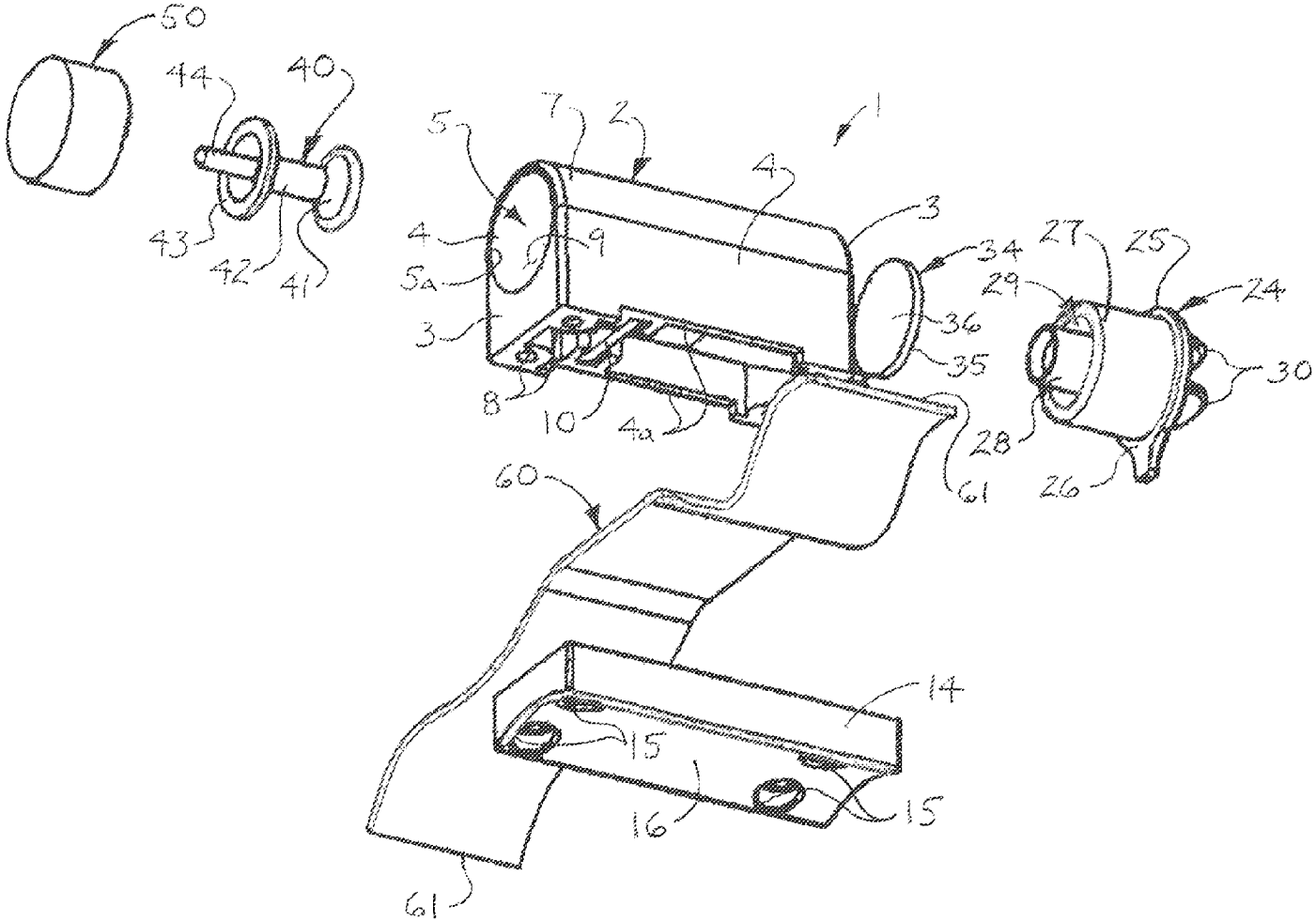
FIG. 3 is an exploded perspective view of an illustrative embodiment of the object locating apparatus.

As will be hereinafter further described, the cartridge 2 may be adapted for attachment to an object such as a rifle 64 (FIG. 9) which is to be located in the event that the rifle 64 inadvertently falls into a body of water 66 and sinks to the bottom 67 of the water body 66. Any suitable attachment mechanism which is known or contrived by those skilled in the art may be used to attach the cartridge 2 to the rifle 64 or other object. In some embodiments, a base plate 14 may be detachably attached to the cartridge 2. An attachment strap 60 may be sandwiched between the cartridge 2 and the base plate 14 to facilitate attachment of the cartridge 2 to the rifle 64 or other object. As illustrated in FIG. 3, in some embodiments, strap notches 4*a* may be provided in the lower edges of the respective cartridge side walls 4 of the cartridge 2. Accordingly, the attachment strap 60 may extend through the strap notches 4*a* between the cartridge 2 and the base plate 14. The strap 60 may have opposite strap ends 61. The strap ends 61 may be securable using any suitable technique known or contrived by those skilled in the art, including but not limited to buckles; snaps; and hook and loop fasteners.

The base plate 14 may be attached to the cartridge 2 according to any suitable technique which is known or contrived by those skilled in the art. As illustrated in FIG. 3, in some embodiments, interiorly-threaded base plate attachment bosses 8 may be provided in the lower portion at the respective corners of the cartridge 2. Fastener openings 15 may extend through the base plate 14 at respective corners thereof. Fasteners (not illustrated) may be extended through the respective fastener openings 15 in the base plate 14 and threaded into the respective base plate attachment bosses 8 in the cartridge 2 to attach the base plate 14 to the cartridge 2. The base plate 14 may have a plate mount surface 16 which engages a complementary mount surface (not illustrated) on the rifle 64 or other object. In some embodiments, the plate mount surface 16 may be generally concave, as illustrated, to mate with a complementary-shaped convex mount surface on the object. In other embodiments, the plate mount surface 16 may be planar or convex to mate with a planar or concave mount surface, respectively, on the object. As further illustrated in FIG. 3, in some embodiments, a line anchor pin 10 may span the cartridge side walls 4 of the cartridge 2 for purposes which will be hereinafter described.

A detachable cartridge cap 24 may be inserted in the cap end 5*b* of the cartridge interior 5. The cartridge cap 24 may include a cap plate 25. A cap lock flange 26 may extend from an edge of the cap plate 25 for purposes which will be hereinafter described. A generally cylindrical outer cap wall 27 may extend from the cap plate 25. A generally cylindrical inner cap wall 28 may extend from the cap plate 25 inside and in generally concentric relationship with respect to the outer cap wall 27. In some embodiments, an annular spring cavity 29 may be defined between the outer cap wall 27 and the inner cap wall 28. At least one grip flange 30 may extend from the outer surface of the cap plate 25 to facilitate manual rotation and insertion and removal of the cartridge cap 24 with respect to the cap end 5*b* of the cartridge interior 5 for purposes which will be hereinafter described. As illustrated in FIG. 4, the cartridge cap 24 may be inserted in the cartridge interior 5 by extending the outer cap wall 27 and the inner cap wall 28 into the cap end 5*b* of the cartridge interior 5 until the cap plate 25 engages the cartridge end wall 3.

Figure 2:
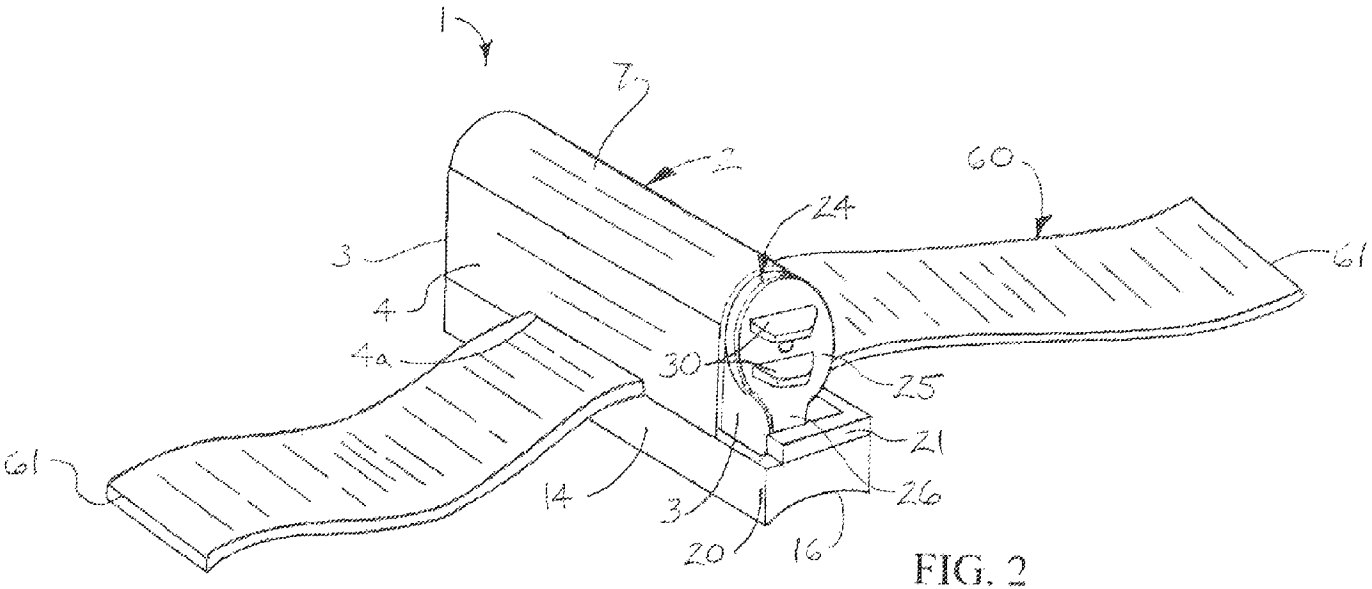
FIG. 2 is a rear perspective view of an illustrative embodiment of the object locating apparatus.

The cartridge cap 24 may be capable of being selectively locked in the cap end 5*b* of the cartridge interior 5 according to any suitable technique which is known or contrived by those skilled in the art. Accordingly, as illustrated in FIG. 2, in some embodiments, the base plate 14 may have a base plate extension 20 which extends beyond the end of the cartridge 2 corresponding to the cap end 5*b* (FIG. 4) of the cartridge interior 5. A cap locking flange 21 may extend upwardly from the base plate extension 20. When the cartridge cap 24 is inserted in the cap end 5*b* of the cartridge interior 5, as illustrated in FTG. 4, the cartridge cap 24 may be rotated between the unlocked position illustrated in FIG. 5, in which the cap lock flange 26 is misaligned with and disengages the cap locking flange 21, and the locked position illustrated in FIGS. 6 and 8, in which the cap lock flange 26 is aligned with and engages the cap locking flange 21, securing the cartridge cap 24 in the cap end 5*b* of the cartridge interior 5.

As illustrated in FIG. 4, a float retainer tablet 34 may be interposed between the cartridge cap 24 and the tablet retainer flange 6 in the cartridge interior 5. The float retainer tablet 34 may be any material which dissolves or the structural solidarity or integrity of which is compromised upon contact with water. The float retainer tablet 34 may have a spring side 35 and a spool side 36. A coiled spring 32 may be seated in the spring cavity 29 of the cartridge cap 24 in encircling relationship to the inner cap wall 28. The spring 32 may have a tablet engaging end 32*a* and a cap engaging end 32*b*. When the cartridge cap 24 is inserted in the cap end 5*b* of the cartridge interior 5 and locked in place (FIGS. 6 and 8), the spring 32 is sandwiched and compressed between the cap plate 25 of the cartridge cap 24 and the spring side 35 of the float retainer tablet 34; thus, the compressed spring 32 urges or biases the float retainer tablet 34 against the tablet retainer flange 6 in the cartridge interior 5.

As further illustrated in FIG. 4, a cartridge spool 40 may be provided in the cartridge interior 5 generally between the tablet retainer flange 6 and the float exit end 5*a* of the cartridge interior 5. The cartridge spool 40 may include a spool base 41, a spool shaft 42 which extends from the spool base 41 and a spool flange 43 on the spool shaft 42. A spool pin 44 may extend beyond the spool flange 43.

A float 50 may be inserted in the float exit end 5*a* of the cartridge interior 5 generally adjacent to the cartridge spool 40. The float 50 may be generally cylindrical. A pin opening 51 may extend generally into or completely through the float 50. The float 50 may be any suitable water-buoyant material. In some embodiments, the float 50 may be a highly-visible color such as bright orange or red, for example and without limitation. The float 50 may be secured in the float exit end 5*a* of the cartridge interior 5 via a friction fit. When the float 50 is inserted in the float exit end 5*a*, as illustrated in FIG. 4, the spool pin 44 of the cartridge spool 40 may extend into the pin opening 51 of the float 50. The spool flange 43 of the cartridge spool 40 may engage the float 50.

A float attachment line 54 may be wound on the spool shaft 42 of the spool 40. A first end of the float attachment line 54 may be attached to the float 50. A second end of the float attachment line 54 may be attached to the line anchor pin 10 (FIG. 3) in the lower portion of the cartridge 2. The float attachment line 54 may extend from the spool 40 to the line anchor pin 10 through a line slot (not illustrated) in the cartridge interior surface 9 of the cartridge 2.

Referring next to FIGS. 3-9 of the drawings, in exemplary application of the apparatus 1, the cartridge 2 is attached to an object such as a rifle 64 (FIG. 9) to facilitate location of the rifle 64 for retrieval in the event that the rifle 64 inadvertently falls and sinks in a water body 66. Accordingly, as illustrated in FIG. 3, the float retainer tablet 34 is inserted in the cap end 5*b* of the cartridge interior 5. The spring 32 (FIG. 4) is inserted in the spring cavity 29 of the cartridge cap 24, and the cartridge cap 24 is inserted in the cap end 5*b* of the cartridge interior 5. As illustrated in FIG. 4, the tablet engaging end 32*a* of the spring 32 engages the spring side 35 of the float retainer tablet 34 and the spring 32 biases the spool side 36 of the float retainer tablet 34 against the tablet retainer flange 6. The cartridge cap 24 is rotated in the counterclockwise direction from the unlocking position (FIG. 5) to the locking position (FIG. 6) such that the cap lock flange 26 of the cartridge cap 24 engages the cap locking flange 21 and the spring 32, engaged by the cartridge cap 24, retains the float retainer tablet 34 against the tablet retainer flange 6.

The cartridge spool 40 is inserted in the float exit end 5*a* of the cartridge interior 5 with the spool base 41 of the cartridge spool 40 generally facing the tablet retainer flange 6. The float 50 is next inserted in the float exit end 5*a* of the cartridge interior 5 adjacent to the cartridge spool 40 with the cartridge pin 44 extending into the pin opening 51 of the float 50. In some embodiments, the friction fit of the float 50 in the cartridge interior 5 prevents the cartridge spool 40 from inadvertently falling from the cartridge interior 5 through the float exit end 5*a*. The cartridge 2 may be attached to the rifle 64 using the attachment strap 60 (FIG. 3).

Figure 7:
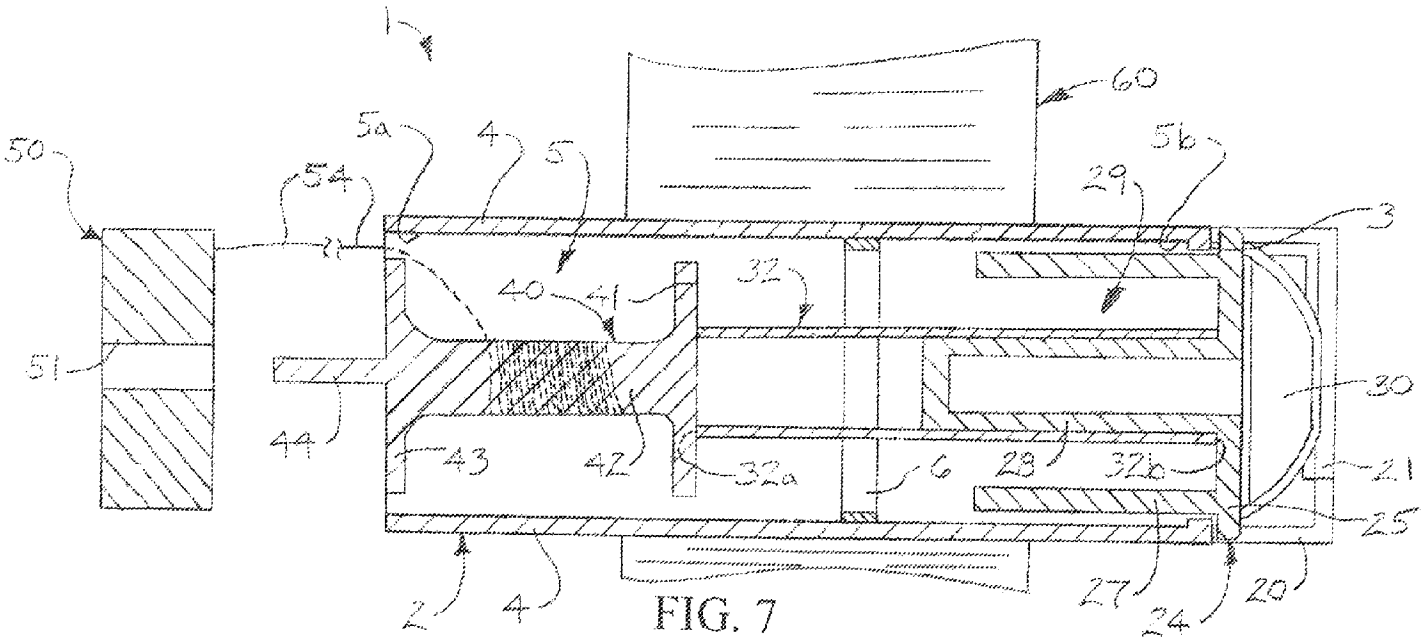
FIG. 7 is a longitudinal sectional view of an illustrative embodiment of the object locating apparatus, with the float of the apparatus deployed in a released configuration.
Figure 8:
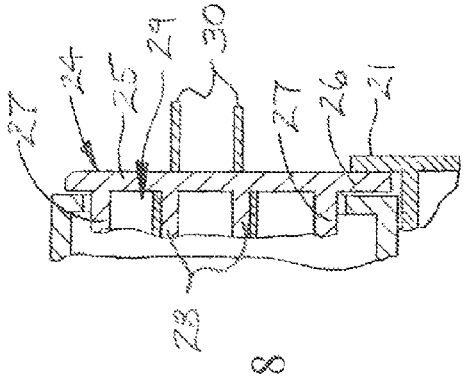
FIG. 8 is a sectional view of the cartridge cap of an illustrative embodiment of the object locating apparatus, deployed in a locking position.
Figure 9:
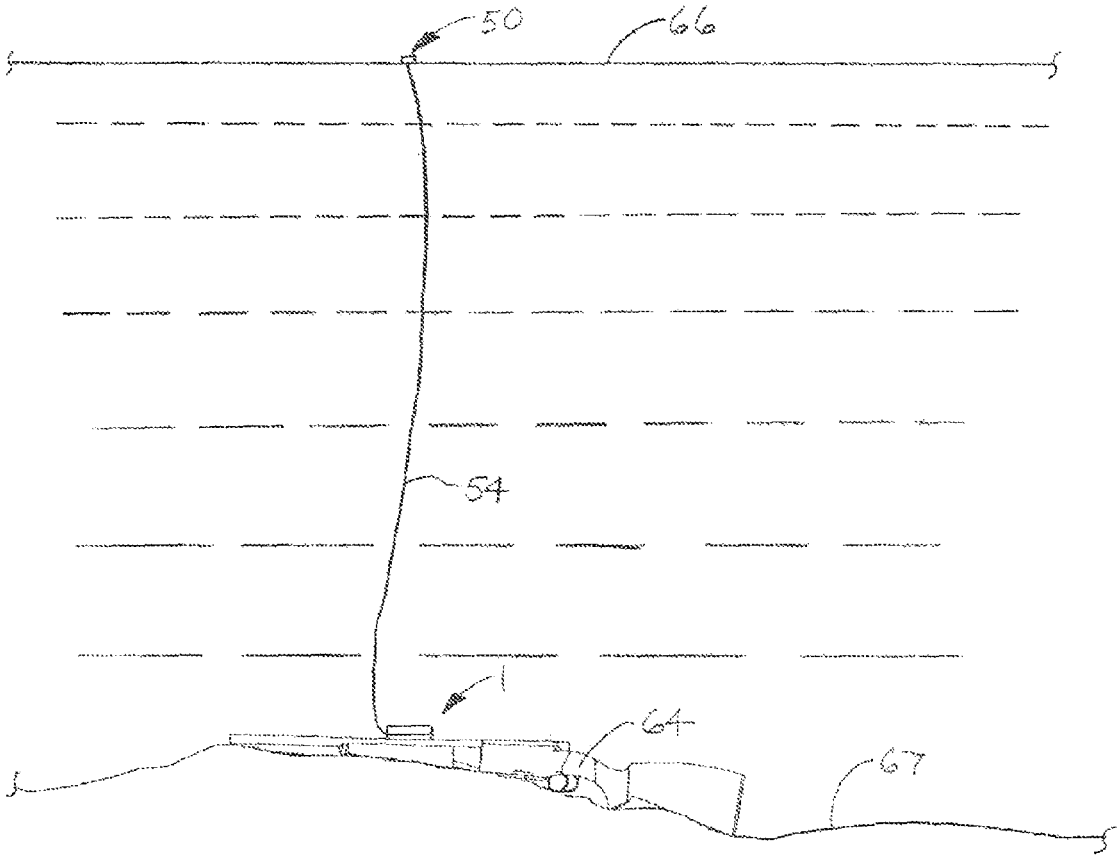
FIG. 9 is a side view of a rifle to which an illustrative embodiment of the object locating apparatus is attached, with the rifle submerged beneath the surface and resting on the bottom of a water body and the float released from the apparatus and floating on the surface of the water body to mark the location of the apparatus on the bottom of the water body.

As illustrated in FIG. 9, in the event that the rifle 64 inadvertently falls and sinks in a body of water 66 such as during hunting, target practice or other use of the rifle 64, the apparatus 1 indicates the location of the rifle 64 to facilitate subsequent retrieval of the rifle 64 from the water body 66. Accordingly, as the rifle 64 descends through and reaches the bottom 67 of the water body 66, water enters the cartridge interior 5 of the cartridge 2 typically through the pin opening 51 of the float 50 and between the cartridge cap 24 and the cartridge end walls 3 of the cartridge 2. The water dissolves the float retainer tablet 34, which formerly maintained the spring 32 in a compressed configuration against the cap plate 25 of the cartridge cap 24. Therefore, the initially compressed spring 32 now expands and extends beyond the tablet retainer flange 6 and engages the spool base 41 of the cartridge spool 40. As illustrated in FIG. 7, the spring 32 pushes the cartridge spool 40 in the cartridge interior 5 toward the float exit end 5*a*. In turn, the cartridge spool 40 pushes the float 50 from the float exit end 5*a* of the cartridge interior 5 into the water body 66.

As the buoyant float 50 rises through and eventually reaches the surface of the water body 66, the float attachment line 54 unwinds from the spool shaft 42 of the spool 40. When the float 50 reaches the surface of the water body 66, the float attachment line 54 stops unwinding from the cartridge spool 40; therefore, the length of the unwound float attachment line 54 substantially corresponds to the depth of the rifle 64 in the water body 66 and the float 50 is located substantially directly over the rifle 64. Therefore, the float 50 marks the location of the rifle 64 in the water body 66. Because of the typically highly-visible appearance of the float 50, a user of the rifle 64 can easily locate the rifle 64 and retrieve the rifle 64 from the water body 66. In some applications, the rifle 64 may be retrieved by grasping the float attachment line 54 and lifting the rifle 64 from the bottom 67 to the surface of the water body 66. It will be appreciated by those skilled in the art that the apparatus 1 can be prepared for re-use by winding the float attachment line 54 on the cartridge spool 40, placing the cartridge spool 40 in the float exit end 5*a* of the cartridge interior 5, inserting the float 50 in the cartridge interior 5 adjacent to the cartridge spool 40, removing the cartridge cap 24 from the cartridge 2, inserting a replacement float retainer tablet 34 in the cap end 5*b* of the cartridge interior 5 and replacing and locking the cartridge cap 24 in the cartridge 2 with the spring 32 biasing the float retainer tablet 34 against the tablet retainer flange 6.

Figure 10:
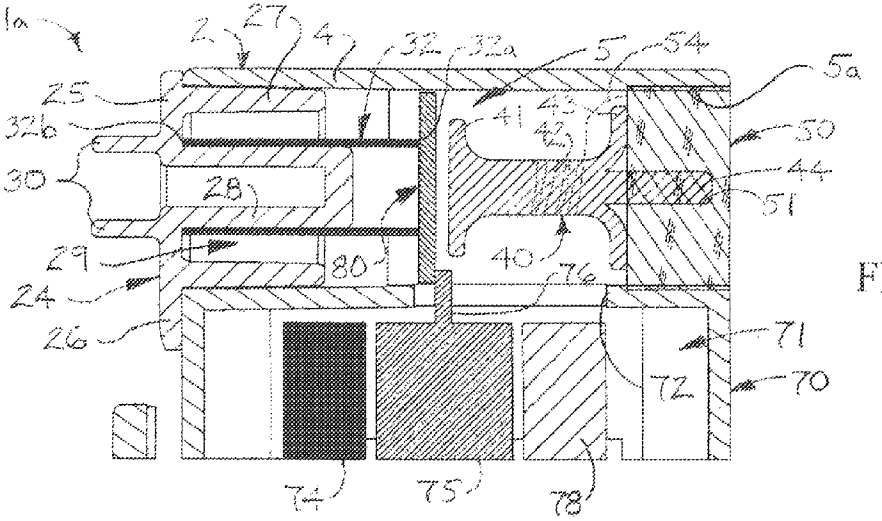
FIG. 10 is a longitudinal sectional view of an alternative illustrative embodiment of the object locating apparatus, with a float of the apparatus deployed in a pre-release configuration.
Figure 11:
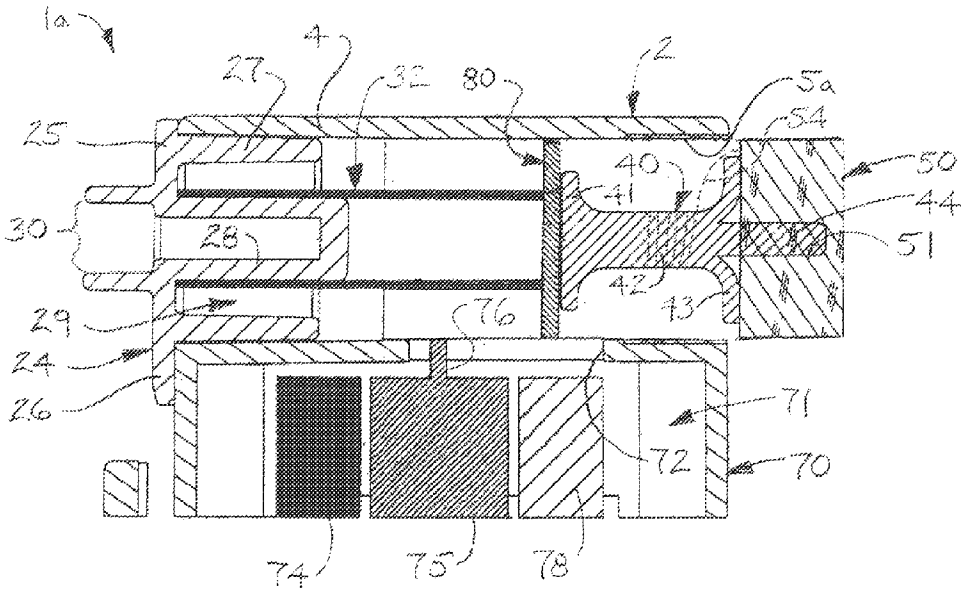
FIG. 11 is a longitudinal sectional view of the object locating apparatus illustrated in FIG. 10, with the float of the apparatus deployed in a released configuration.

Referring next to FIGS. 10 and 11 of the drawings, an alternative illustrative embodiment of the object locating apparatus is generally indicated by reference numeral 1*a*. The apparatus 1*a* may include a cartridge base 70 having a cartridge base interior 71. A cartridge 2 may be provided on the cartridge base 70. The cartridge 2 of the apparatus 1*a* may be similar in design to the cartridge 2 of the apparatus 1 in FIGS. 1-9. In the apparatus 1*a*, a trigger plate 80 may be provided in the cartridge interior 5 of the cartridge 2 between the cartridge cap 24 and the cartridge spool 40. The spring 32, seated in the spring cavity 29 of the cartridge cap 24, engages the trigger plate 80.

In some embodiments, the cartridge base 70 may have an open bottom. An activator flange opening 72 may be provided in the cartridge base 70. A solenoid 75 may be provided in the cartridge base 70. The solenoid 75 may have an extendable and retractable actuator flange 76 which normally extends through the actuator flange opening 72 into the cartridge interior 5 of the cartridge 2 between the trigger plate 80 and the spool base 41 of the cartridge spool 40. Water-sensing circuitry 74 and a battery 78 may interface with the solenoid 75. The water-sensing circuitry 74 may be any type of circuitry which senses the presence of water and which is known by or may be contrived by those of ordinary skill in the art. Accordingly, in the event that the water-sensing circuitry 74 senses the presence of water in the cartridge base interior 71, the solenoid 75 retracts the actuator flange 76 from the cartridge interior 5 of the cartridge 2 through the actuator flange opening 72.

The spring 32 of the apparatus 1*a* may normally bias the trigger plate 80 against the actuator flange 76. Accordingly, in the event that the object (not illustrated) to which the apparatus 1*a* is attached inadvertently falls into a body of water, water enters the cartridge base interior 71 of the cartridge base 70. The water-sensing circuitry 74 senses the water and causes the solenoid 75 to retract the actuator flange 76 from the cartridge interior 5 through the actuator flange opening 72. Accordingly, as illustrated in FIG. 11, the spring 32 pushes the trigger plate 80 against the spool base 41 of the cartridge spool 40. In turn, the cartridge spool 40 pushes the float 50 from the float exit end 5*a* of the cartridge interior 5 into the water body. The float 50 floats to the surface of the water body and marks the location of the object as was heretofore described with respect to the apparatus 1 in FIG. 9.

Figure 12:
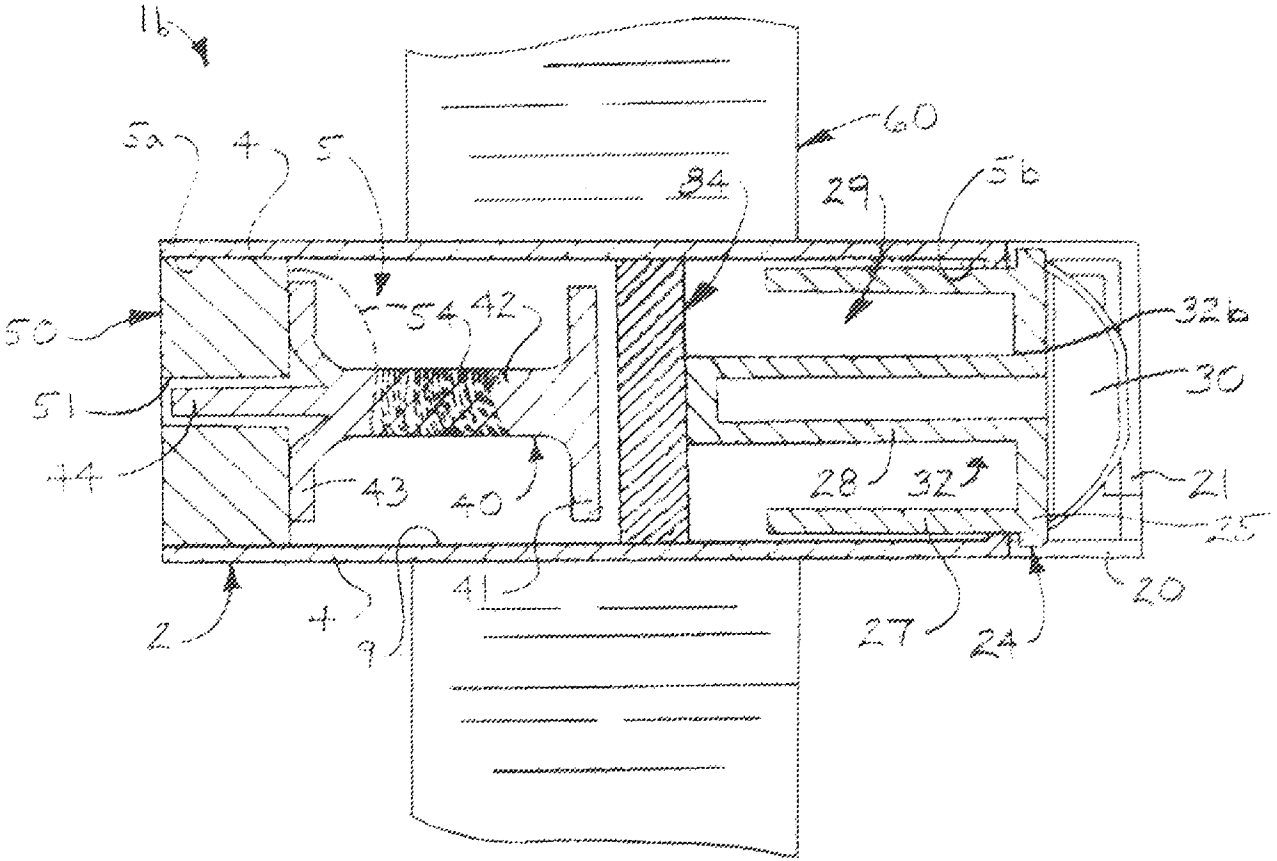
FIG. 12 is a longitudinal sectional view of another alternative illustrative embodiment of the object locating apparatus, with the float of the apparatus deployed in a pre-release configuration.
Figure 13:
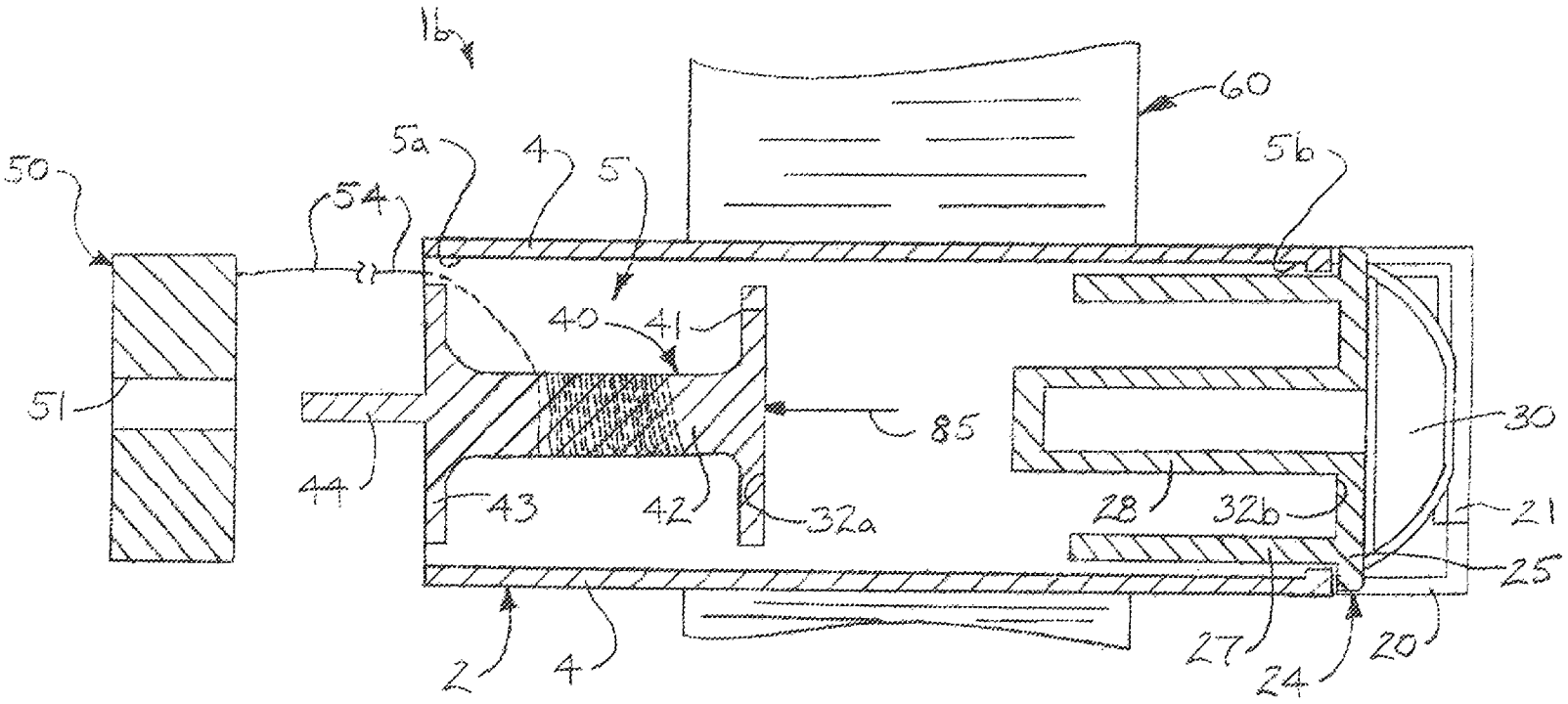
FIG. 13 is a longitudinal sectional view of another alternative illustrative embodiment of the object locating apparatus, with the float of the apparatus deployed in a released configuration.
Figure 15:
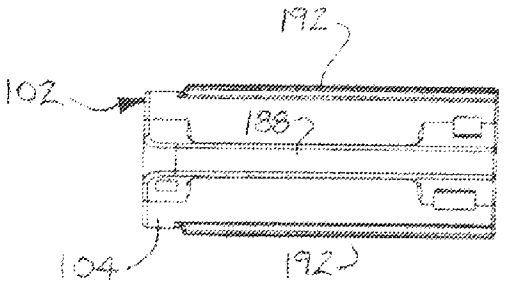
FIG. 15 is a side view of the cartridge illustrated in FIG. 14.

Referring next to FIGS. 12 and 13 of the drawings, another alternative illustrative embodiment of the object locating apparatus is generally indicated by reference numeral 1*b*. The apparatus 1*b* may have a design which is similar to that of the apparatus 1 in FIGS. 1-9, with a base plate 14 (FIG. 3) and a cartridge 2 on the base plate 14. In the apparatus 1*b*, a pressure tablet 84 (FIG. 12) may be interposed generally between the inner cap wall 28 of the cartridge cap 24 and the spool base 41 of the cartridge spool 40 ip the cartridge interior 5 of the cartridge 2. The pressure tablet 84 may be any type of chemical or material which generates a pressurized gas upon contact and reaction with water. For example and without limitation, in some embodiments, the pressure tablet 84 may be sodium bicarbonate, which generates carbon dioxide gas upon reaction with water. Accordingly, in the event that the rifle 64 (FIG. 9) or other object to which the apparatus 1*b* is attached inadvertently falls into a water body, water enters the cartridge interior 5 and dissolves the pressure tablet 84. The combination of the water and the dissolved pressure tablet 84 creates gas pressure 85 (FIG. 13) which pushes the spool base 41 of the cartridge spool 40 toward the float exit end 5*a* of the cartridge interior 5. In turn, the cartridge spool 40 pushes the float 50 from the float exit end 5*a* of the cartridge 2 into the water body. The float 50 floats to the surface of the water body and marks the location of the object as was heretofore described with respect to the apparatus 1 in FIG. 9.

Figure 18:
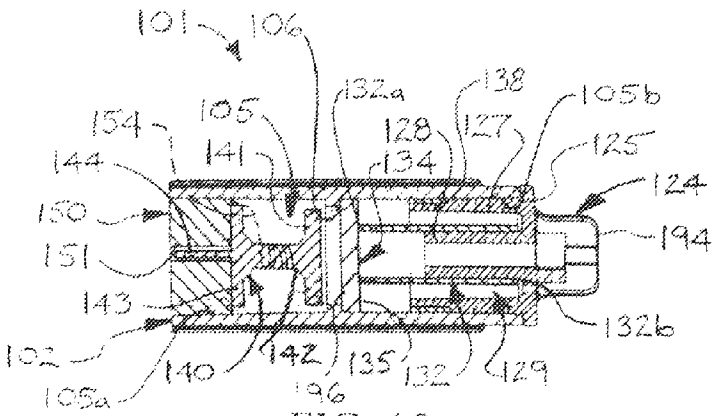
FIG. 18 is a longitudinal sectional view of an illustrative embodiment of the object locating apparatus which includes the cartridge illustrated in FIGS. 14-16 and the cartridge cap illustrated in FIG. 17, with a float of the apparatus deployed in a pre-release configuration.

Referring next to FIGS. 14-22 of the drawings, another alternative illustrative embodiment of the object locating apparatus is generally indicated by reference numeral 101 in FIG. 18. In the apparatus 101, elements which are analogous to the respective elements of the apparatus 1 that was heretofore described with respect to FIGS. 1-9 are designated by the same numeral in the 100 series in FIGS. 14-18. Therefore, the description of the apparatus 1 in FIGS. 1-9 generally applies to the description of the apparatus 101.

A pair of strap frames 188 may extend from the cartridge 102 of the apparatus 101. In some embodiments, the strap frames 188 may be disposed in generally diametrically-opposed relationship to each other about the circumference of the cartridge 102. A strap slot 189 may be defined between each strap frame 188 and the cartridge 102. Accordingly, an attachment strap 160 (illustrated in phantom in FIG. 16) may be extended through each corresponding strap slot 189 to facilitate attachment of the cartridge 102 of the apparatus 101 to the rifle 64 (FIG. 9) or other object typically as was heretofore described with respect to the apparatus 1. In some embodiments, at least one pair of generally elongated, spaced-apart, parallel cartridge stabilizing rails 192 may extend along at least a portion of the length of the cartridge 102. In some embodiments, two pairs of cartridge stabilizing rails 192 may extend along at least a portion of the length of the cartridge 102 in generally diametrically-opposed relationship to each other, as illustrated, for purposes which will be hereinafter described.

The float attachment line 154 (FIG. 18) which attaches the float 150 to the cartridge spool 140 may be anchored to the cartridge 102 according to any suitable technique which is known or may be contrived by those skilled in the art. In some embodiments, a line attachment slot 198 (FIG. 14) may extend through the cartridge side wall 104 of the cartridge 102. A first end of the float attachment line 154 (FIG. 18) may be extended through the line attachment slot 198 and tied to the cartridge side wall 104. The float attachment line 154 may then be wound around the spool shaft 142 of the cartridge spool 140 and a second end of the float attachment line 154 attached to the float 150 according to the knowledge of those skilled in the art.

Figure 17:
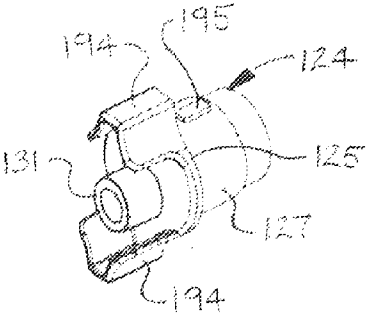
FIG. 17 is a perspective view of a cartridge cap for the cartridge illustrated in FIG. 14.
Figure 14:
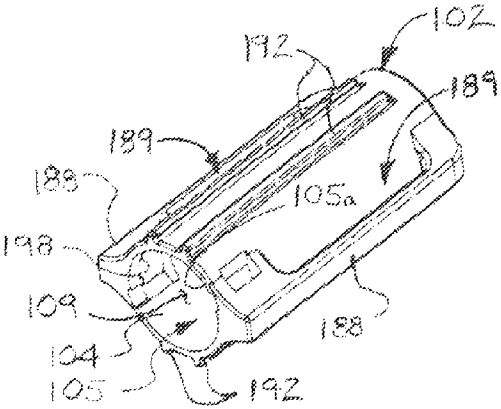
FIG. 14 is a perspective view of a cartridge of an alternative illustrative embodiment of the object locating apparatus.
Figure 16:
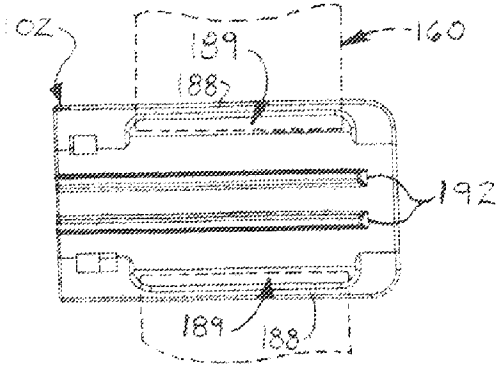
FIG. 16 is a top view of the cartridge illustrated in FIG. 14.
Figure 19:
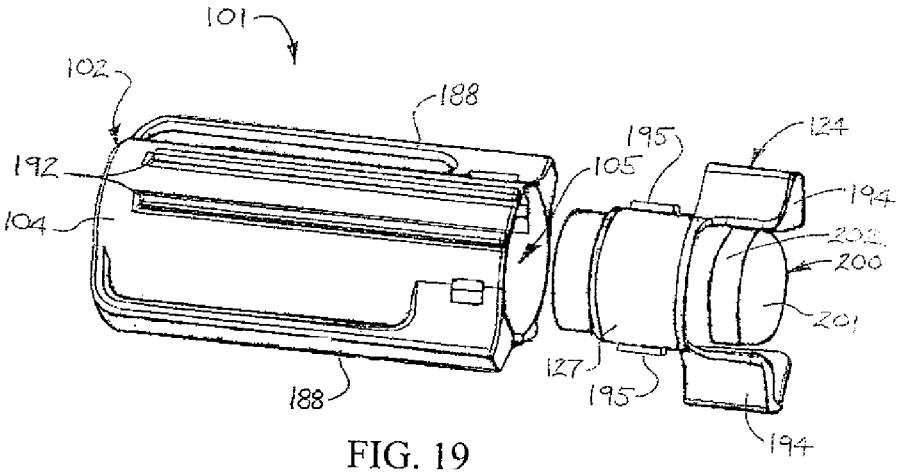
FIG. 19 is an exploded perspective view of another alternative illustrative embodiment of embodiment of the object locating apparatus.
Figure 20:
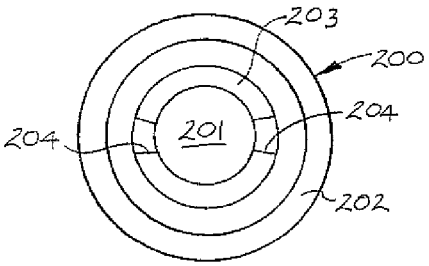
FIG. 20 is a rear view of a vent cap of the object locating apparatus illustrated in FIG. 19.
Figure 21:
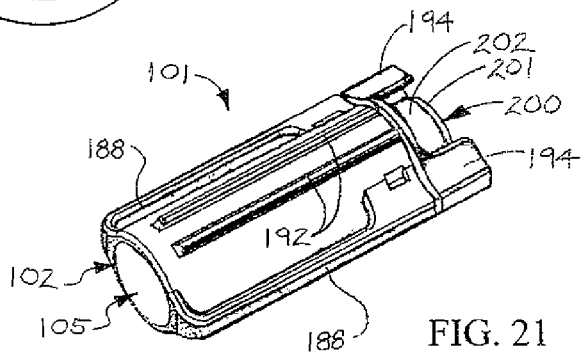
FIG. 21 is a perspective view of the assembled object locating apparatus illustrated in FIG. 19.
Figure 22:
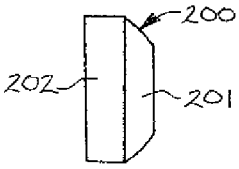
FIG. 22 is a side view of the vent cap.

As illustrated in FIG. 17, the cartridge cap 124 of the apparatus 101 may include a cap plate 125 and an outer cap wall 127 and an inner cap wall 128 (FIG. 18) which extend from the cap plate 125. The inner cap wall 128 may be generally concentric with the outer cap wall 127. An annular spring cavity 129 may be defined between the outer cap wall 127 and the inner cap wall 128. A pair of spaced-apart cap handles 194 may extend from the cap plate 125 to provide finger grips for manual rotation and locking and unlocking of the cartridge cap 124 in the cartridge interior 105 of the cartridge 102 as will be hereinafter further described.

The cartridge cap 124 may be capable of being selectively locked in the cap end 105*b* of the cartridge interior 105 according to any suitable technique which is known or may be contrived by those skilled in the art. In some embodiments, at least one cap lock flange 195 (FIG. 17) may extend from the exterior surface of the outer cap wall 127 of the cartridge cap 124. At least one cap lock flange opening (not illustrated) may be provided in the interior surface of the cartridge 102 in the cartridge interior 105. Accordingly, the outer cap wall 127 of the cartridge cap 124 is inserted in the cap end 105*b* of the cartridge interior 105 and the cartridge cap 124 rotated in a first direction to facilitate engagement of the cap lock flange 195 with the corresponding cap flange opening and retain the cartridge cap 124 in the cartridge interior 105. The cartridge cap 124 can be rotated in the opposite direction to disengage the cap lock flange 195 from the cap lock flange opening and facilitate removal of the cartridge cap 124 from the cartridge interior 105. As illustrated in FIG. 17, in some embodiments, a vent cap mount sleeve 131 may extend from the cap plate 125 generally between the cap handles 194 of the cartridge cap 124 for purposes which will be hereinafter described.

Use of the apparatus 101 may be as was heretofore described with respect to the apparatus 1 in FIG. 9. Accordingly, a water-dissolvable tablet 196 may be inserted in the cap end 105*b* of the cartridge interior 105 and seated against the tablet retaining flange 106. The water-dissolvable tablet 196 may be any material which dissolves or the structural solidarity or integrity of which is compromised upon contact with water. In some embodiments, the water-dissolvable tablet 196 may be a paper material which softens or breaks upon contact with water. A spring 132 is inserted in the spring cavity 129 of the cartridge cap 124 and is normally sandwiched and compressed between the cap plate 125 of the cartridge cap 124 and the float retainer tablet 134. Thus, the spring 132 engages and biases the float retainer tablet 134 against the tablet retainer flange 106 as the outer cap wall 127 of the cartridge cap 124 is inserted in the cartridge interior 105. The cartridge cap 124 may be rotated to lock the cartridge cap 124 in place as was heretofore described.

The float attachment line 154, one end of which may be tied to the cartridge 102 at the line attachment slot 198 (FIG. 14), is wound around the spool shaft 142 of the cartridge spool 140. The float 150, attached to the opposite end of the float attachment line 154, is inserted in the float exit end 105*a* of the cartridge interior 105. The spool pin 144 of the cartridge spool 140 may be inserted into the pin opening 151 in the float 150.

The cartridge 102 of the apparatus 101 may be attached to a rifle 64 (FIG. 9) or other object by placing one of the pairs of cartridge rails 192 against the surface of the rifle 64. The straps 160 (illustrated in phantom in FIG. 16) which extend through the respective strap slots 189 formed by the strap frames 188 are extended around the rifle 64 and may be fastened using a suitable fastening mechanism (not illustrated) such as buckles, snaps or hook and loop fasteners, for example and without limitation. It will be appreciated by those skilled in the art that the cartridge rails 192 stabilize the cartridge 102 on the surface of the rifle 64 as the apparatus 101 remains attached to the rifle 64.

In the event that the rifle 64 inadvertently falls and sinks in a body of water 66 (FIG. 9), water enters the cartridge interior 105 and dissolves the float retainer tablet 134. Therefore, the initially compressed spring 132 now expands and extends beyond the tablet retainer flange 6 and engages the spool base 41 of the cartridge spool 40. As illustrated in FIG. 7, the spring 32 pushes the cartridge spool 140 in the cartridge interior 105 toward the float exit end 105*a* and the cartridge spool 140 pushes the float 150 from the float exit end 105*a* of the cartridge interior 105 into the water body 66. The buoyant float 150 rises through and eventually reaches the surface of the water body 66 as the float attachment line 154 unwinds from the spool shaft 142 of the spool 140. Therefore, the float 150 marks the location of the rifle 64 in the water body 66 and a user of the rifle 64 can easily locate the rifle 64 and retrieve the rifle 64 from the water body 66.

In alternative embodiments, the spring 132 may be omitted. The dissolvable table 196 may be a pressure tablet which may be any type of chemical or material which generates a pressurized gas upon contact and reaction with water such as sodium bicarbonate, for example and without limitation. Accordingly, in the event that the rifle 64 (FIG. 9) or other object to which the apparatus 101 is attached inadvertently falls into a water body, water enters the cartridge interior 105 and dissolves the pressure tablet 196. The combination of the water and the dissolved pressure tablet 196 creates gas pressure which pushes the spool base 141 of the cartridge spool 140 toward the float exit end 105*a* of the cartridge interior 105. In turn, the cartridge spool 140 pushes the float 150 from the float exit end 105*a* of the cartridge 102 into the water body. The float 150 floats to the surface of the water body and marks the location of the object as was heretofore described.

As illustrated in FIGS. 19-22, in some embodiments, the cartridge cap 124 may be fitted with a vent cap 200. The vent cap 200 may include a vent cap front wall 201. An annular vent cap outer wall 202 may extend from the vent cap front wall 201. An annular vent cap inner wall 203 may extend from the vent cap front wall 201 in concentric relationship to the vent cap outer wall 202. At least one water inlet notch 204 may be provided in the vent cap inner wall 203. In some embodiments, a pair of water inlet notches 204 may be provided in the vent cap inner wall 203, as illustrated.

The vent cap 200 may be fitted on the cartridge cap 124 by placing the vent cap 200 between the cap handles 194 such that the vent cap mount sleeve 131 of the cartridge cap 124 is inserted into the opening formed by the vent cap inner wall 203 (FIG. 20) of the vent cap 200. In some embodiments, the vent cap 200 may be glued in place on the vent cap mount sleeve 131. In other embodiments, the vent cap 200 may be friction-fitted on the vent cap mount sleeve 131. In still other embodiments, alternative attachment techniques known by those skilled in the art may be used to attach the vent cap 200 to the vent cap mount sleeve 131. Accordingly, in exemplary application of the apparatus 101, which may be as was heretofore described, as the rifle 64 (FIG. 9) is submerged in the water body 66, the water flows into the cartridge interior 105 of the cartridge 102 through the water inlet notches 204 (FIG. 20) and the vent cap mount sleeve 131. The water in the cartridge interior 105 dissolves or compromises the dissolvable tablet 196 as was heretofore described. The vent cap 200 provides controlled flow of water and prevents water from forcefully splashing into the cartridge interior 105.

While various illustrative embodiments of the disclosure have been described above, it will be recognized and understood that various modifications can be made in the disclosure and the appended claims are intended to cover all such modifications which may fall within the spirit and scope of the embodiments of the disclosure.

What is claimed is:

1. An object locating apparatus, comprising:

a cartridge having a cartridge interior;

a float in said cartridge interior;

a float attachment line attached to said float and said cartridge;

a water-dissolvable float retainer tablet retained in said cartridge interior;

a cartridge cap in said cartridge interior;

a spring normally sandwiched and compressed between said cartridge cap and said float retainer tablet and adapted to expand and push said float from said cartridge interior upon dissolving of said float retainer tablet;

a cartridge spool in said cartridge interior generally adjacent to said float, said float attachment line wound on said cartridge spool; and a tablet retainer flange in said cartridge interior generally between said cartridge spool and said cartridge cap, said spring biases said float retainer tablet against said tablet retainer flange.

2. The apparatus of claim 1 further comprising a pair of strap frames carried by said cartridge; a pair of strap slots between said pair of strap frames and said cartridge, respectively; and a pair of attachment straps extending through said pair of strap slots, respectively.

3. The apparatus of claim 1 wherein said cartridge cap comprises a cap plate, an outer cap wall extending from said cap plate, an inner cap wall extending from said cap plate inside and in generally concentric relationship to said outer cap wall and an annular spring cavity between said outer cap wall and said inner cap wall, and wherein said spring is seated in said spring cavity.

4. The apparatus of claim 1 further comprising at least one pair of generally elongated, parallel, spaced-apart cartridge rails on said cartridge.

5. The apparatus of claim 1 further comprising a vent cap carried by said cartridge cap.

6. The apparatus of claim 1 further comprising a pin opening in said float and a spool pin extending from said cartridge spool and inserted in said pin opening.

7. An object locating apparatus, comprising:

a cartridge having a cartridge interior;

a float in said cartridge interior;

a float attachment line attached to said float and said cartridge;

a water-dissolvable pressure tablet in said cartridge interior, said pressure tablet adapted to generate pressurized gas upon contact with water;

a cartridge cap in said cartridge interior generally adjacent to said pressure tablet; and a vent cap carried by said cartridge cap.

8. The apparatus of claim 7 further comprising a cartridge spool in said cartridge interior generally adjacent to said float and wherein said float attachment line is wound on said cartridge spool.

9. The apparatus of claim 7 further comprising a pair of strap frames carried by said cartridge; a pair of strap slots between said pair of strap frames and said cartridge, respectively; and a pair of attachment straps extending through said pair of strap slots, respectively.

10. The apparatus of claim 7 wherein said cartridge cap comprises a cap plate, an outer cap wall extending from said cap plate, an inner cap wall extending from said cap plate inside and in generally concentric relationship to said outer cap wall and an annular spring cavity between said outer cap wall and said inner cap wall, and wherein said spring is seated in said spring cavity.

11. The apparatus of claim 7 further comprising at least one pair of generally elongated, parallel, spaced-apart cartridge rails on said cartridge.

12. The apparatus of claim 7 further comprising a cartridge spool in said cartridge interior generally adjacent to said float and wherein said float attachment line is wound on said cartridge spool, and a pin opening in said float and a spool pin extending from said cartridge spool and inserted in said pin opening.

13. An object locating apparatus, comprising:

a cartridge having a cartridge interior;

a float in said cartridge interior;

a float attachment line attached to said float and said cartridge;

a trigger plate in said cartridge interior;

a solenoid having an actuator flange positional into and out of said cartridge interior generally between said float and said trigger plate, said actuator flange normally positioned in said cartridge interior;

water-sensing circuitry connected to said solenoid; and a spring normally biasing said trigger plate against said actuator flange and adapted to expand and push said float from said cartridge interior upon positioning of said actuator flange of said solenoid out of said cartridge interior.

14. The apparatus of claim 13 further comprising a cartridge spool in said cartridge interior generally adjacent to said float and wherein said float attachment line is wound on said cartridge spool.

15. The apparatus of claim 13 further comprising a cartridge cap in said cartridge interior generally adjacent to said trigger plate.

16. The apparatus of claim 15 wherein said cartridge cap comprises a cap plate, an outer cap wall extending from said cap plate, an inner cap wall extending from said cap plate inside and in generally concentric relationship to said outer cap wall and a spring cavity between said outer cap wall and said inner cap wall, and wherein said spring is seated in said spring cavity.

17. The apparatus of claim 16 further comprising at least one grip flange carried by said cap plate.

* * * * *